US006263925B1

(12) United States Patent
Olsen

(10) Patent No.: US 6,263,925 B1
(45) Date of Patent: Jul. 24, 2001

(54) ACTUATOR FOR CAN FILLING APPARATUS

(76) Inventor: Gary H. Olsen, 12994 W. Lancaster Ave., Butler, WI (US) 53007

( * ) Notice: Subject to any disclaimer, the term of this patent is extended or adjusted under 35 U.S.C. 154(b) by 0 days.

(21) Appl. No.: 09/574,594

(22) Filed: May 19, 2000

(51) Int. Cl.[7] ..... B65B 1/04
(52) U.S. Cl. ..... 141/156; 141/146
(58) Field of Search ..... 141/129, 156, 141/157, 181, 182, 144, 145, 146, 147

(56) References Cited

U.S. PATENT DOCUMENTS 4,522,238 * 6/1985 Minard ..... 141/142
5,058,632 * 10/1991 Lawarre, Sr. et al. ..... 141/39

* cited by examiner

*Primary Examiner*—Steven O. Douglas

(74) *Attorney, Agent, or Firm*—Ryan Kromholz & Manion, SC

(57) ABSTRACT

An actuator mechanism is provided for a device for automatically filling cans with a carbonated beverage. The filling apparatus is of a type wherein a valve is raised and lowered for the purpose of introduction of pressurized gas into each successive container and wherein raising and lowering is accomplished by rotation of a shaft having an end with operates to raise a valve member. The opposite end of the shaft has a lever arm extending therefrom which is depressed for the purpose for rotating the shaft. The invention provides an improved actuator mechanism supported on the apparatus and which has an extendible and retractable piston member actuated by a pneumatic cylinder for depressing the lever arm. The piston member supports a lever arm-engaging block having a surface for engaging the lever arm which block is convexly, arcuately contoured and has a width substantially equal to the length of the lever arm. Preferably the convex surface is asymmetrically contoured and a part of its surface which is adapted to engage and depress lever arm generally parallels the surface of the lever arm.

4 Claims, 3 Drawing Sheets

14
18
20
15
17
16
22
26
24
38
36
32
30
34
28

58
60
62
66
22
24
26
36
32
30
34
35
40
39

ACTUATOR FOR CAN FILLING APPARATUS

The present invention relates to can filling apparatus used for automatically filling cans with carbonated beverages. More specifically, the invention deals with an actuator for a valve trip mechanism for a needle valve used to open a passageway to charge beverage cans which are being filled with carbon dioxide prior to introduction therein of a beverage.

BACKGROUND OF THE INVENTION

Can filling devices typically utilize an annular sleeve, commonly referred to as a "tulip" which engages the top of an empty can. The mechanism includes passageways for allowing gravity flow into the can of the beverage liquid and a central tube for introduction of carbon dioxide gas into the can. The carbon dioxide gas is introduced for the purpose of flushing out any air from the interior of the can and to charge the can. Opening of the central tube also equalizes pressure in the system, allowing liquid to run into the can. The central tube has a stem at the top thereof which is engaged by a bifurcated lever and raised and lowered to cause opening and closing of a valve at the top of the tube, thereby starting and stopping the flow of carbon dioxide gas into the can.

The forked or bifurcated lever used to control the opening and closing of the stem valve is raised and lowered by rotation of a shaft with which it is integral. The opposite end of the shaft from the bifurcated lever has a two-pronged handle secured thereto commonly referred to as a "butterfly". Opening of the needle valve is accomplished by pushing downwardly on the uppermost arm of the butterfly to rotate the shaft in one direction, whereas closing thereof is caused by passage of the lower arm of the butterfly along a cam surface, which causes rotation of the shaft in the opposite direction. Generally the cam surface is a stationary track and the can filling apparatus is traveling in a circular path wherein the butterfly is acted on by the cam surface at an appropriate position required for closing of the needle valve at the appropriate time in the can filling cycle.

In accordance with current practice the shaft carrying the bifurcated lever is caused to rotate by extension against the upper butterfly arm of an extendible and retractable shaft which is actuated by an pneumatic cylinder. The extendible/retractable shaft has a blunt end with rounded edges which is of a small diameter and spaced so as to strike the butterfly arm at a point offset from the central axis of the rotatable shaft.

Due this design, the upper arm of the butterfly routinely wears out or becomes grooved or gouged by repeated action there against of the extendible arm. Also, the rotatable shaft, itself, becomes loosened in its bearings due to the torque applied by the off-axis impact of the end of the extendible rod. The rotatable shaft is desirably frictionally held so as to avoid free rotation thereof. When worn, the shaft will rotate too easily so that the needle valve may open too rapidly and thereby be allowed to impact against other parts of the mechanism usually, the top of the beverage-containing reservoir, eventually causing the needle valve to fail. Failure of this mechanism causes a substantial loss in terms of down time, wasted beverage and various problems caused by the need to disassemble the can filling apparatus.

In view of the foregoing problems, a need has existed for improved mechanisms for controlling the valves in can filling equipment.

SUMMARY OF THE INVENTION

It is a principal object of the present invention to provide an improved control mechanism for effecting opening of a can charging valve of the type used in filling cans with carbonated beverages. In accordance with a related aspect of the invention, the actuator mechanism provided by this mechanism, substantially minimizes wear of a butterfly control arm. Such arms are often formed of a plastic material.

In accordance with a related aspect of the invention, an actuator is provided which has a butterfly lever arm-engaging surface of a width approximating the length of the butterfly lever arm which it engages, and in any event, having the width of at least major portion, ie, at least ¾ of the length of the butterfly lever arm.

In accordance with another related aspect of the invention, the actuating surface is an arcuately curved surface with a curvature of a substantially greater radius than heretofore used is such actuating devices. This contour allows for a somewhat rolling action of the actuator against the butterfly lever arm as it slides along the length of the arm thus substantially minimizing the stresses imposed on the actuator mechanism.

In accordance still further aspects of the invention, the central axis of the actuator arm is closely aligned with the central axis of the rotatable arm which rotates to lift the bifurcated lever arm and, hence, the needle valve. Thus bending forces which cause excessive wear of the shaft bearing are minimized.

Briefly, the invention provides an actuator mechanism for a device for automatically filling cans with a carbonated beverage. The filling apparatus is of a type wherein a valve is raised and lowered for the purpose of introduction of pressurized gas into each successive container and wherein raising and lowering is accomplished by rotation of a shaft having an end with operates to raise a valve member. The opposite end of the shaft has a lever arm extending therefrom which is depressed for the purpose for rotating the shaft. The invention provides an improved actuator mechanism supported on the apparatus and which has an extendible and retractable piston member actuated by a pneumatic cylinder for depressing the lever arm. The piston member supports a lever arm-engaging block having a surface for engaging the lever arm which block is convexly, arcuately contoured and has a width substantially equal to the length of the lever arm. Preferably the convex surface is asymmetrically contoured and a part of its surface which is adapted to engage and depress lever arm generally parallels the surface of the lever arm.

Further objects and advantages of the invention will be apparent from the following description, the attached claims and the accompanying drawings.

DETAILED DESCRIPTION OF THE INVENTION

Figures 1, 2:
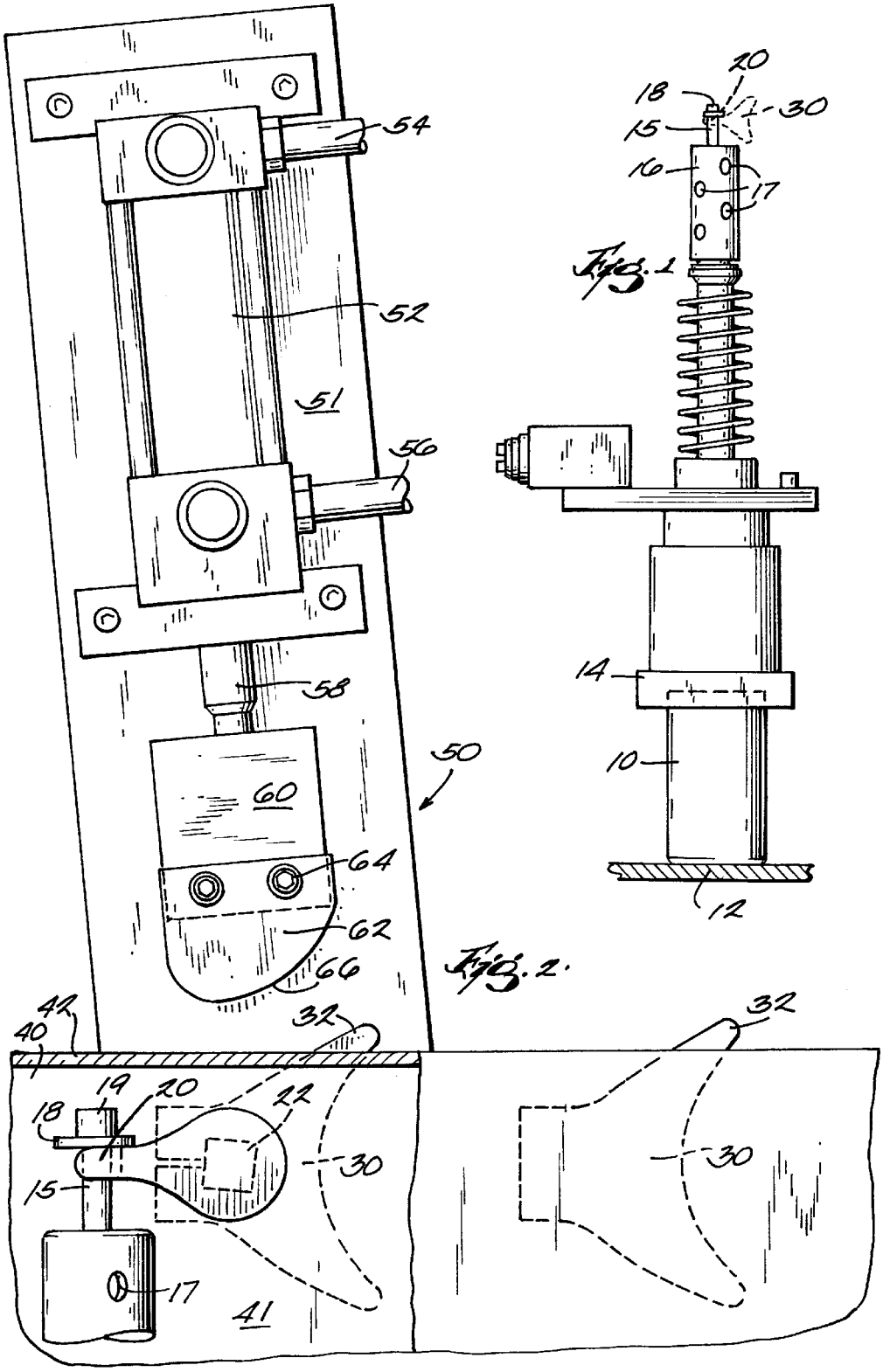
FIG. 1 is a fragmentary side elevational view, with exterior parts omitted, showing a single can in conjunction with automatic can filling apparatus.
FIG. 2 is a side elevational view with parts in cross section showing a can filling actuator mechanism.

FIG. 1 shows a single can 10 on a traveling supporting surface 12 of an automatic can filling machine. An annular can engaging component known in the industry as a "tulip" 14 engages the top of the can 10 during filling. The tulip contains passageways which allow the inflow of liquids such as soda or beer into the can 10. The tulip also contains a central flow tube for allowing carbon dioxide to be supplied to the can 10. The carbon dioxide gas is used to first flush any air from within the can 10. Subsequently, beer or other beverage is allowed to flow by gravity into can 10 while the carbon dioxide is expelled back out through the central flow tube back to the supply reservoir. Pressurized chamber 40, which surrounds valve assembly 16 wherein carbon dioxide and beer are confined, forms this reservoir.

Valve assembly 16 is used to control the flow of carbon dioxide gas through the central flow tube into the can 10. A stem 15 at the top of the valve control cap 16 which holds a spring-loaded central valve needle is used for raising and lowering the valve needle to thereby open and close the valve. Air flow openings 17 allow the surrounding carbon dioxide gas to pass through the central flow tube when cap 16 is raised to open the valve. Generally a spring loaded plastic needle assembly is contained within the cap 16 and is used for opening and closing the central gas flow tube.

Figure 3:
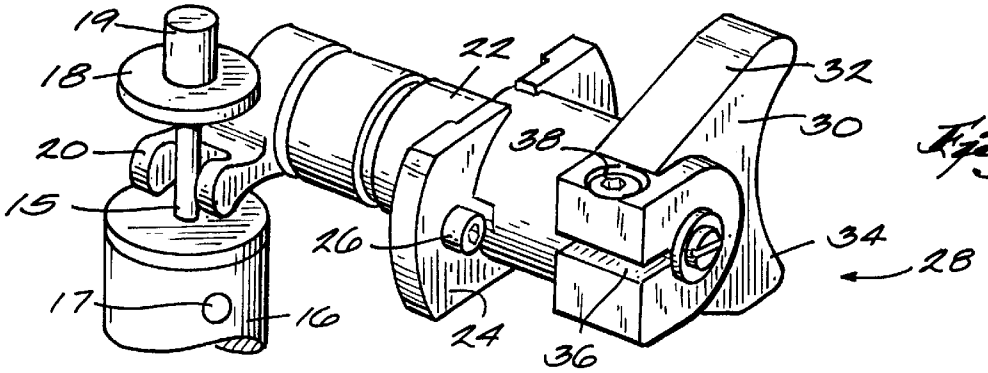
FIG. 3 is a perspective view showing a valve actuator lever in conjunction with a gas needle valve stem illustrated in fragmentary form.

Referring to FIG. 3, the lever assembly used to lift the stem 15 is generally identified by numeral 28. The lever assembly 28 includes a bifurcated lever member 20 adapted to extend on opposite sides of the stem 15, and, when raised, to lift the same by engaging the bottom of a washer-like protrusion 18 which is integral with the stem 15. Stem 15 has an upper end 19 which prevents excessive upward movement of the stem 15 by eventually impacting the top 42 of fluid containing chamber 40 (see FIGS. 2 and 6).

Figure 6:
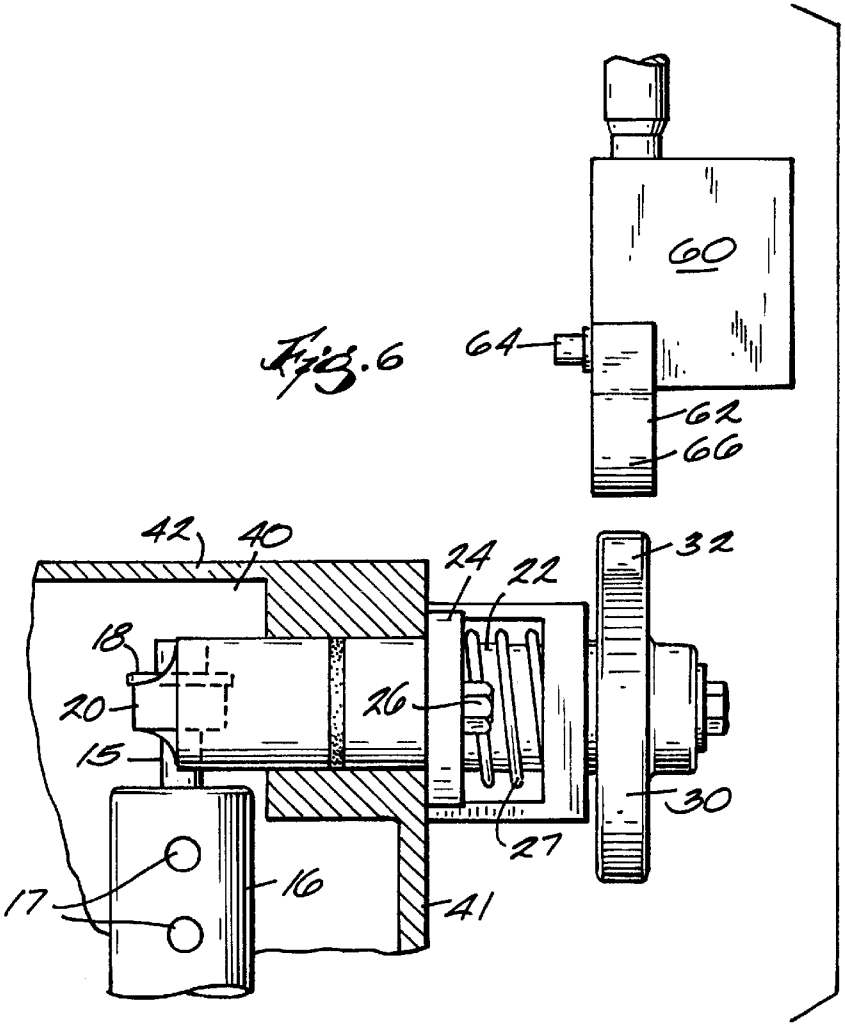

Lever assembly 28 has a central shaft 22 and a mounting flange 24 which provides a means for securing the lever assembly 28 to the side wall 41 of fluid chamber 40 by means of bolts or screws 26. As seen in FIG. 6, a spring assembly 27, encircles the shaft 22 and assists in providing resistance against rotation of the shaft 22.

Butterfly member 30 provides a pair of lever ends 32 and 34 The butterfly member 30 and shaft 22 are rotated clockwise as viewed in FIG. 3 to raise the bifurcated end 20 and thus the stem 15. To cause such rotation, downward force is applied to the upper lever end 32 of the butterfly 30. Rotation of the shaft 22 in the counterclockwise direction in FIG. 3 is caused by applying an upward force on the lower lever member 34 of the butterfly 30. This is accomplished by having the lever 34 ride over a stationary cam 35 as the can filling assembly rotates in the direction of arrow 39. As also seen in FIG. 3, the butterfly 30 is attached to the end of shaft 22 by means of a bolt or screw 38 which compresses a slotted end of 36 of the butterfly onto the shaft 22.

Referring to FIG. 2 again, the chamber 40 within which valve assembly 16, inner end of shaft 22, and bifurcated actuator lever 20 are located, is a substantially closed pressurized chamber which includes side walls 41 and a cover plate 42. This chamber, which encloses the $CO_2$ gas and the beverage, is not shown in FIG. 1 for purposes of clarity. The automated can filling equipment is well known in the art.

As already noted, the bottom portion of the chamber 40 contains the beverage which enters the can 10 by gravity flow. The portion of the chamber 40 above the liquid beverage contains compressed carbon dioxide gas. Also, as noted, when the valve assembly 16 is lifted, a flow channel for the carbon dioxide gas is opened so that the gas can first enter the can and subsequently, when pushed out by the inflowing liquid, can exit the can back into the top of reservoir chamber 40. This flow ceases when the liquid level in can 10 rises sufficiently to close the central gas flow tube.

Figure 4:
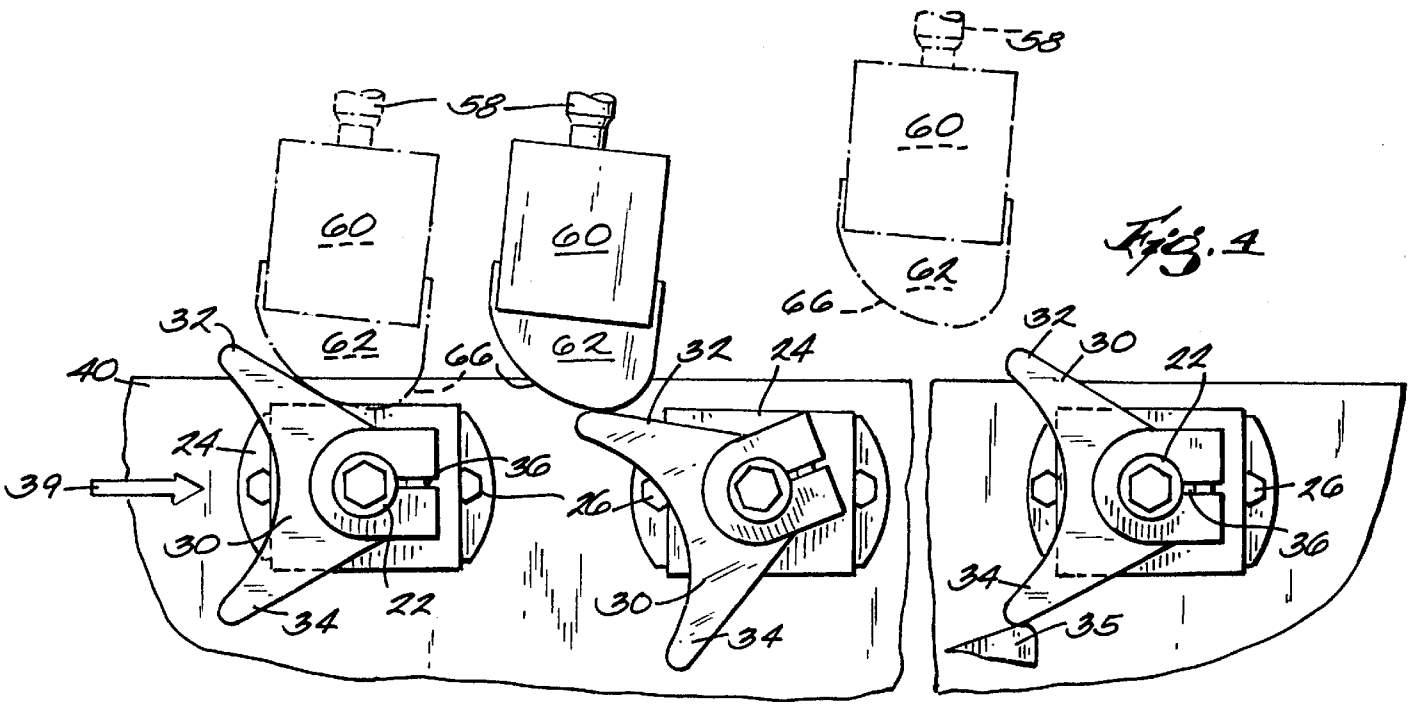
FIG. 4 is a fragmentary view showing an actuator of this invention in conjunction with a butterfly valve actuator with alternate positions shown by phantom lines.
Figure 5:
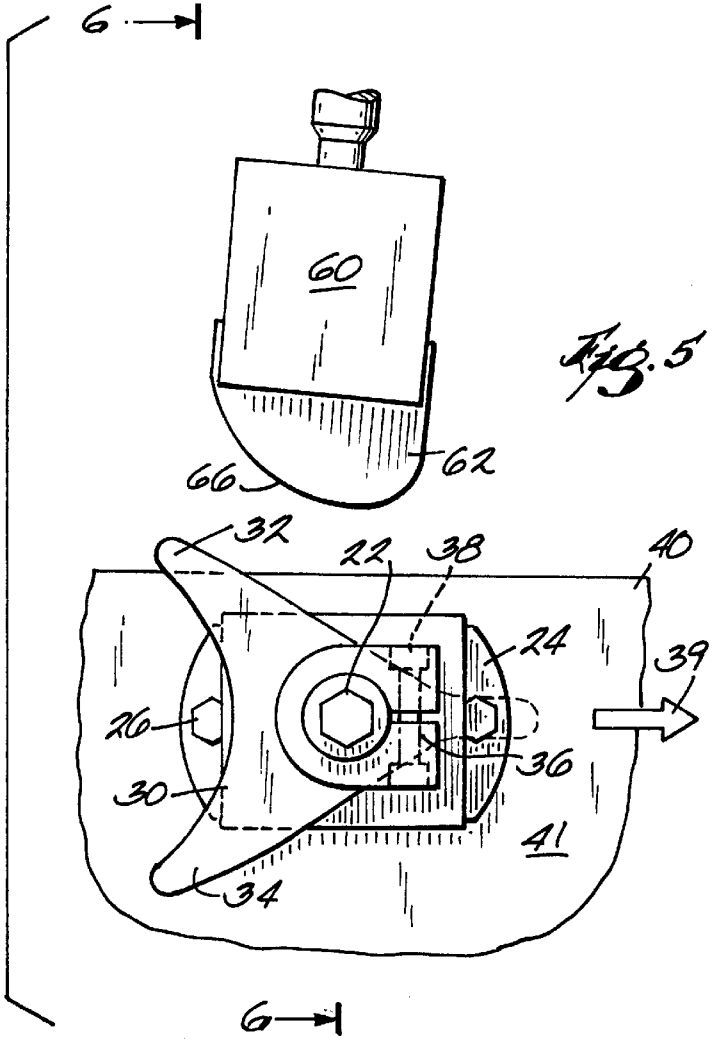
FIG. 5 is a fragmentary end view showing a valve actuator mounted on can filling apparatus shown in fragmentary form in conjunction with a valve actuator also shown in fragmentary form; and, FIG. 6 is a cross-sectional view taken long line 6—6 of FIG. 5.

Referring to FIG. 2, the novel actuator mechanism 50 of this invention will be described. The actuator mechanism 50 is supported on a mounting plate 51 which is supported on a stationary component of the can filling apparatus. Thus, when the can filling apparatus is in operation, the filler assembly 16 and valve operating lever assembly 28 travel past the actuator mechanism 50. The direction of travel is indicated by arrows 39 in FIGS. 4 and 5. The actuator assembly 50 is supported on a mounting plate 51 at oblique angle only slightly offset from the vertical. A pneumatically operated cylinder 52 is connected to sources of pressurized pneumatic fluid by means of conduits 54 and 56 in conventional fashion in order to supply power for extending and retracting, a piston rod 58. Piston rod 58 is attached to a mounting block 60 to which a butterfly lever striker block 62 is, in turn, attached by means of mechanical fasteners 64. As seen in FIG. 2, the striker block 62 has a width approximately as great as the length of butterfly lever arm 32 which it is adapted to contact to move the lever arm downwardly, as best seen in FIG. 4 as the lever arm travels past the actuator. Block 62 also has a lever contacting surface 66 which is convexly arcuately contoured in a manner, offset to one side of it's center, such that when it contacts the upper surface of butterfly lever arm 32, a maximum contact surface is provided. The contact point constantly changes as the lever arm 32 travels past the extending block 62. The edge 66 of block 62 which contacts arm 32 is of an arc having a substantially greater radius than actuator mechanisms heretofore available. It should also be noted from FIG. 2, that due to the substantial width of the block 62, the motion of the actuator is offset only a minimal amount from the central axis of the lever assembly central shaft 22.

As seen in FIG. 4, the arcuate surface 66 slides along and depresses the lever arm 32 smoothly as the mechanism rotates in the direction of the arrow 39, thereby minimizing gouging or other wear of the upper surface of the arm 32 which has been experienced with heretofore available actuator devices. Also, as previously noted, the cam 35 returns the butterfly 30 to its initial position wherein it is ready to operate in connection with the filling of another successive can.

While certain preferred embodiments have been illustrated and described herein, it will be readily apparent to those skilled in the art that modifications and additions may be made to the apparatus to those skilled in the art without departing from the spirit and scope of the invention.

What is claimed is:

1. In a traveling device for automatically filling cans with a beverage wherein a valve is raised and lowered for the purpose of introduction of pressurized gas into each successive container, and wherein said raising and lowering is accomplished by rotation of a shaft having an end with operates to raise a valve member, and an opposite end having a lever arm extending therefrom which is depressed for the purpose for rotating said shaft, the improvement which comprises an actuator mechanism supported on a stationary surface on said apparatus and having an extendible and retractable piston member for depressing said lever, said piston member being extended and retracted by means of a pneumatic cylinder, said piston rod member supporting a lever arm engaging block having a surface for engaging said lever, said block being convexly arcuately contoured and having a width approximately equal to the length of said lever arm, said block being adapted to engage and depress said lever arm as said apparatus travels relative to said actuator mechanism when said piston member is extended.

2. Apparatus according to claim 1 wherein said convex surface is asymmetrically contoured and wherein a part of said surface which is adapted to engage and depress said lever arm generally parallels the surface of said lever arm.

3. Apparatus according to claim 1 wherein the width of said block is at least ¾ of the length of said arm.

4. Apparatus according to claim 1 wherein said arm is adapted to slide along said convexly arcuately contoured block as said traveling device travels relative to said actuator mechanism.

* * * * *